United States Patent [19]

Foldesi et al.

[11] Patent Number: 4,816,110

[45] Date of Patent: Mar. 28, 1989

[54] IN-LINE SEALER

[75] Inventors: Istvan Foldesi, Laval; Ludwik Cudnoch, Montreal; Marcel P. Belanger, Ste-Julie-de-Vercheres, all of Canada

[73] Assignee: Montreal Milling Cutter Co., Inc., Quebec, Canada

[21] Appl. No.: 91,183

[22] Filed: Aug. 31, 1987

[51] Int. Cl.[4] ..... B65B 7/28; B65C 9/14

[52] U.S. Cl. ..... 156/499; 53/307; 53/DIG. 2; 156/379.8; 156/567; 156/571; 156/DIG. 31

[58] Field of Search ..... 156/69, 497, 499, 379.8, 156/379.6, 567, 568, 571, DIG. 25, DIG. 31; 53/307, 309, 373, DIG. 2

[56] References Cited

U.S. PATENT DOCUMENTS

| | | | |
|---|---|---|---|
| 1,864,008 | 6/1932 | Wright et al. | 53/307 |
| 3,214,886 | 11/1965 | Pechmann | 53/309 |
| 3,487,622 | 1/1970 | Mueller | 53/307 |
| 3,628,307 | 12/1971 | Croasdale et al. | 53/307 |
| 3,712,023 | 1/1973 | Bryan et al. | 53/307 |
| 3,908,340 | 9/1975 | Erhardt | 53/307 |
| 3,939,625 | 2/1976 | Remele et al. | 53/307 |
| 4,065,909 | 1/1978 | Mueller | 53/307 |
| 4,246,461 | 1/1981 | Jeppson | 156/69 |
| 4,297,828 | 11/1981 | Krieger et al. | 53/307 |
| 4,414,056 | 11/1983 | Buchholz et al. | 156/567 |
| 4,613,397 | 9/1986 | Buchholz | 156/567 |
| 4,691,500 | 9/1987 | Danforth et al. | 53/307 |

*Primary Examiner*—Michael Wityshyn

*Attorney, Agent, or Firm*—Flynn, Thiel, Boutell & Tanis

[57] ABSTRACT

An in-line sealer apparatus for applying and sealing foils to the mouth of sequentially presented containers. The apparatus includes a rotatable turret having a pocket wheel containing angularly spaced pockets for accommodating containers. Each pocket has a foil transfer and sealing mechanism which is associated therewith and mounted on the turret arrangement for rotation therewith. Each mechanism includes a stacker unit which removably attaches to the turret and stores therein a stack of foils. Each mechanism also includes a foil transfer and applying unit which is disposed below the stacker and includes a movable foil-engaging head for removing the lowermost foil in the stack, and thereafter transferring the foil and applying it to the mouth of the container positioned within the respective pocket. When so positioned, the container moves through a heating channel, while the head presses the foil against the container mouth, to seal the foil to the mouth, following which the head is removed and the container discharged from the turret arrangement.

8 Claims, 6 Drawing Sheets

IN-LINE SEALER

FIELD OF THE INVENTION

This invention relates to an in-line sealer and, in particular, to an improved turret-type sealing apparatus for permitting rapid and efficient performance of sequential operations, such as application and sealing of foils to containers.

BACKGROUND OF THE INVENTION

At the present time, many containers particularly for food products employ an inner seal, known as a "foil", sealed to the mouth of the container. The container additionally has a separate removable cap positioned over the foil and attached to the container by either a snap connection or a screw-type thread. Many of the machines for applying the foil and cap to the container rely on a technique whereby the foil is initially positioned within the cap, and the foil-cap combination is then attached to the container in a single assembly operation, which operation is such as to also effect sealing of the foil to the container mouth. With this type operation, however, it is difficult to determine if the foil properly seals against the container mouth. In fact, in some instances the foil may even fall out of the cap prior to the combination being attached to the container, and in such instance the sealing foil is missing and yet such can not be readily detected once the cap is attached to the container.

Accordingly, the present invention relates to an improved apparatus designed, in a preferred utilization thereof, for positioning and sealingly attaching a foil to the mouth of a container prior to and wholly independent of the attachment of the cap to the container.

In the apparatus of the present invention, there is preferably provided a rotatable turret having multiple sealing stations provided in circumferentially-spaced relationship therearound. Each sealing station has a removable stacker unit associated therewith, which unit holds therein a large quantity of vertically-stacked foils so as to permit the apparatus to operate for long periods of time without shut-down. A foil transfer unit is associated below each stacker unit but above each container-receiving location on the turret so that the lowermost foil can be removed from the stack, with the foil then being inverted by the transfer unit and lowered into sealing engagement with the mouth of the container. The container and the foil pass through an arcuately elongated heating structure, such as an induction heater, which extends circumferentially of the turret to ensure proper sealing attachment of the foil to the container mouth. The rotation of the apparatus, and the presence of multiple sealing stations positioned therearound, each having its own stacker unit and foil transfer unit, hence enables containers to be sealed at a rapid rate. Since the sealing occurs prior to application of the cap, inspection can be readily carried out to ensure that the foil is sealingly engaged with the container mouth.

Other objects and purposes of the invention will be apparent to persons familiar with apparatus of this general type upon reading the following specification and inspecting the accompanying drawings.

Figure 1:
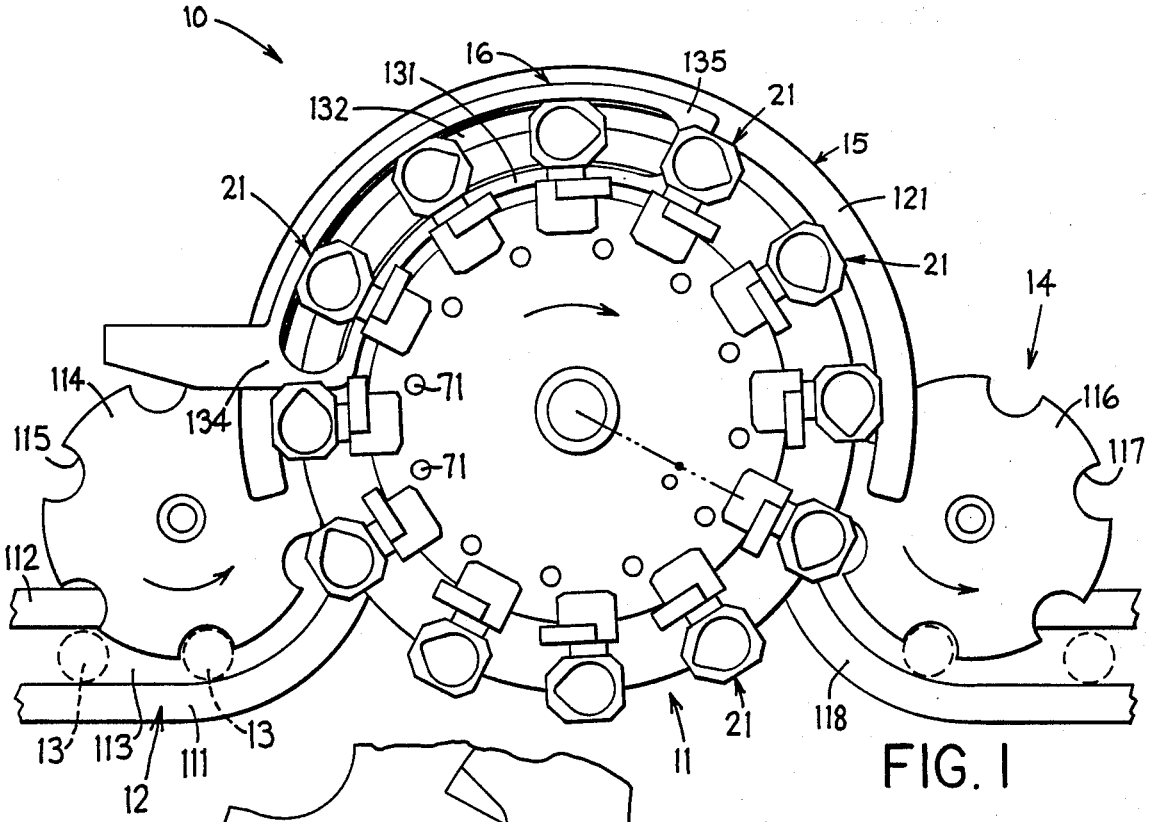
FIG. 1 is a fragmentary top view of the in-line sealer of the present invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the apparatus and designated parts thereof. Said terminology will include the words specifically mentioned, derivatives thereof, and words of similar import.

DETAILED DESCRIPTION

Referring to the drawings, and specifically FIG. 1, there is illustrated an in-line sealer apparatus 10 according to the present invention. This apparatus includes a turntable or turret arrangement 11 for applying and sealing foils to the mouth or rim of containers 13 as they move sequentially in line around a part of the periphery of the turret arrangement. A supply or inputting device 12 is preferably disposed adjacent one side of the turret arrangement for sequentially feeding containers 13 to the turret arrangement in properly spaced intervals. A discharge or removal device 14 is also preferably provided adjacent the periphery of the turret arrangement, such as on the opposite side from the supply device 12, to effect sequential removal of the containers 13 after foils have been sealed over the mouths thereof. A guide arrangement 15 extends around the periphery of the turret arrangement from the supply device 12 in the direction of rotation to the discharge device 14 to maintain the containers 13 in engagement with the turret arrangement. This guide arrangement 15 includes a heating channel 16 which extends through a substantial arcuate extent.

The turret arrangement 11 includes a turret 17 (FIG. 3) which is supported on a suitable housing or frame 18 and projects upwardly therefrom for rotation about a substantially vertical axis 19 which projects centrally of the turret arrangement. The turret arrangement defines a plurality (twelve in the illustrated embodiment) of sealing stations 21 thereon in uniformly angularly spaced relationship around the periphery thereof. These stations are adapted to apply a thin flexible sheetlike foil disk 22 to the mouth or rim of a filled container or jar and then seal this foil disk to the container rim prior to any capping operation. The construction of the foil disk 22 is conventional.

The sealing station 21 includes a stacker unit 23 which is stationarily but removably mounted adjacent the periphery of the turret 17, which unit 23 supports a vertical stack of foils therein as described hereinafter. A foil transfer unit 24 is positioned below the stacker unit 23 for removing the individual lowermost foil from the stacker unit and applying it to the mouth or rim of the container which is spaced downwardly from the stacker unit. Suitable control means 25 control the operation of the transfer unit 24. Each sealing station 21 includes the latter-mentioned structure, and hence only a single sealing station is illustrated and described in detail hereinafter.

Figure 2:
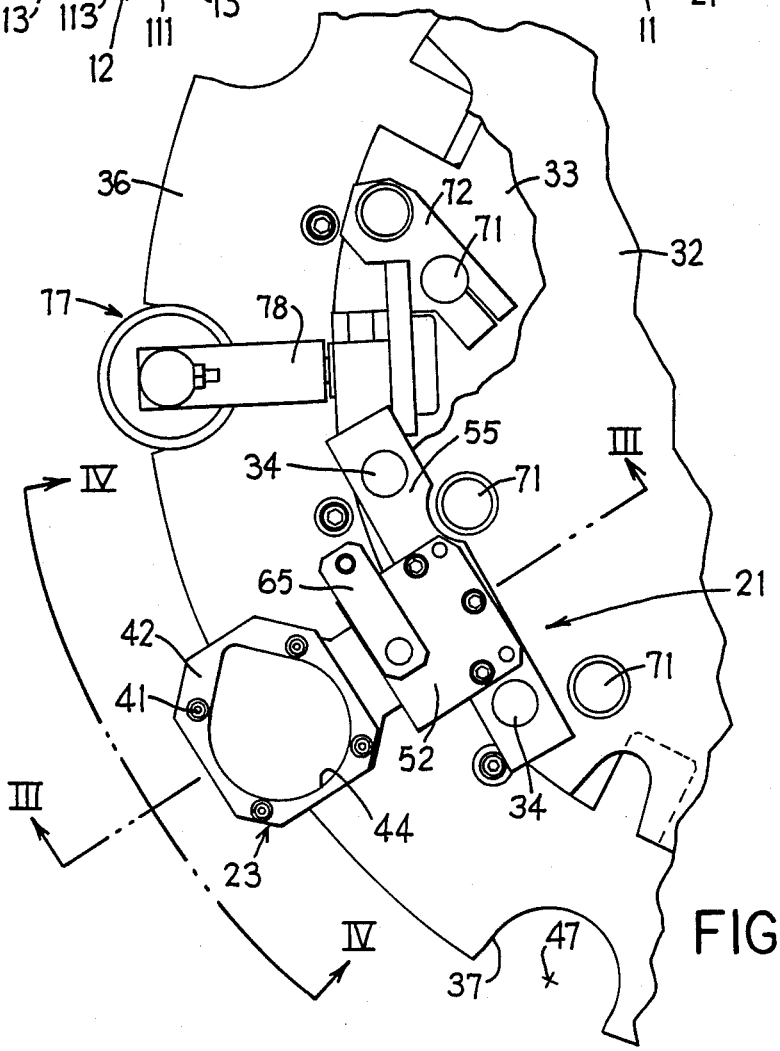
FIG. 2 is an enlarged top view showing a fragmentary portion of the sealer, and specifically showing a stacking unit at only a single location for convenience in illustration.
Figure 3:
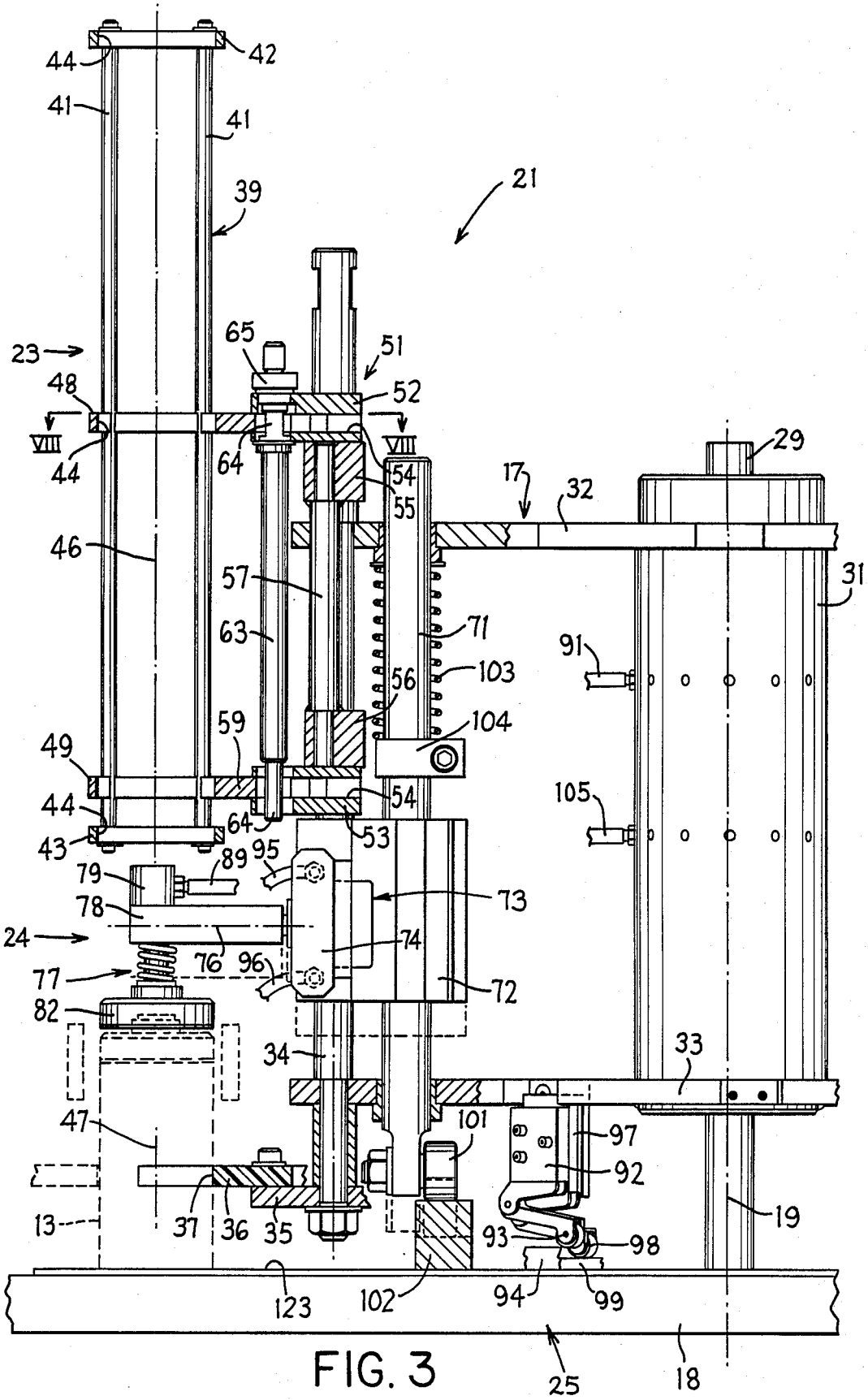
FIG. 3 is an elevational view of a single sealing station, this view being partially in cross section and taken substantially along line III—III in FIG. 2.

Referring to FIG. 2 and 3, the turret 17 includes a main vertically elongated support hub or tube 31 mounted on a drive shaft 29 which projects vertically upwardly from and is rotatably supported relative to the housing, the shaft being rotatably driven from a motor (not shown) in a conventional manner at a substantially uniform rotational velocity. The support hub 31, which rotates with the shaft about its axis 19, has upper and lower support plates 32 and 33, respectively, fixed thereto and projecting radially outwardly therefrom in generally parallel relationship. A plurality of vertically extending posts 34 stationarily extend between the support plates 32 and 33 in the vicinity of the outer peripheral edges thereof. The number of posts 34 correspond to the number of sealing stations 21, this being twelve in the illustrated embodiment. The posts 34 project downwardly below the lower support plate 33 and securely mount a ringlike holder plate 35 in generally parallel but downwardly spaced relationship from the lower support plate 33. This holder plate 35 in turn has a ringlike pocket wheel 36 fixedly attached thereto. This pocket wheel 36 is disposed in a generally horizontal plane, is concentric to the rotational axis 19, and projects radially outwardly beyond the periphery of the support plates 32 and 33. The pocket wheel 36 has a plurality of pockets or recesses 37 opening outwardly at the outer periphery thereof. One pocket 37 is aligned substantially with each sealing station 21, and the pocket 37 has a depth which slightly exceeds the radius of the container 13, and has a substantially semicylindrical configuration which approximately corresponds to the outer configuration of the container 13 so as to enable the container 13 to be properly seated within the pocket.

Considering now the stacker unit 23 (FIGS. 3 and 4), this unit includes a vertically elongated open framework 39 formed by a plurality (here four) of vertically elongated rods 41 disposed in generally parallel relationship. The four rods 41 are disposed in a generally rectangular array, and are rigidly joined together by top and bottom end plates 42 and 43, respectively. These end plates 42 and 43 each have identical openings 44 therethrough which, as indicated by FIG. 2, are generally circular but may be provided with a sideward extension to accommodate a foil having a tab thereon. The configuration of the opening 44 corresponds to the configuration of the foil 22, although the opening 44 is generally slightly larger. To permit a vertical stack 45 of foils to be retained within the framework 39, a plurality of small fingers 38 are fixed to the bottom end 43 and project just slightly inwardly beneath the stack 45. The centerline 46 of the openings 44, which centerline corresponds to the centerline of the foil, is vertically aligned with the center 47 of the respective pocket 37.

The stacker unit 23 also has upper and lower mounting plates 48 and 49, respectively, fixedly attached to the framework 39 and projecting sidewardly (that is, horizontally) therefrom. These mounting plates 48 and 49 also have identical openings 44 extending vertically therethrough.

Figure 4:
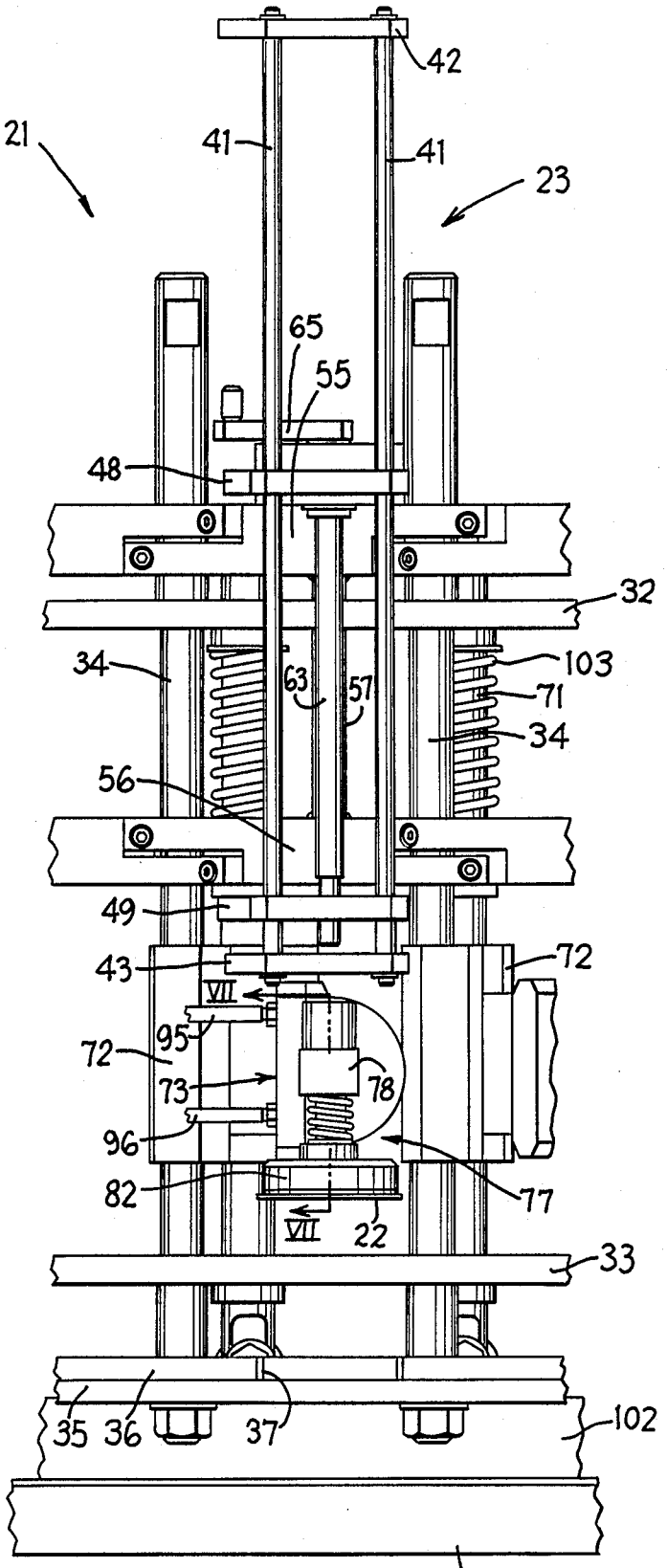
FIG. 4 is a peripheral elevational view of a single sealing station as taken substantially along line IV—IV in FIG. 2.

To permit the stacker unit 23 to be readily removed from the turret 17 when desired, such as when it is empty so that it can be replaced with a different stacker unit having a stack of foils therein, each sealing station 21 has a releasable locking means 51 (FIGS. 3 and 4) associated therewith and carried by the turret. The releasable locking means 51 includes upper and lower locking plates 52 and 53, respectively, each having a tunnel-like slot 54 opening therethrough along a direction which is substantially radial relative to the turret. The locking plates are stationarily mounted on a holder which includes upper and lower arms 55 and 56, respectively, the latter respectively fixedly mounting thereon the locking plates 52 and 53. The arms 55 and 56 are rigidly joined together by a vertically extending rod 57, the latter projecting through a suitable opening in the upper support plate 32. The opposite ends of the arms 56 and 57 have vertical openings therethrough which accommodate the adjacent pair of turret posts 34 so that the holder defined by the arms 55,56 and rod 57 is rigidly secured relative to the turret. As illustrated in FIG. 4, each arm 55 and 56 has a generally Z-shaped vertical configuration when viewed from peripherally of the turret so that the arms associated with adjacent sealing stations can have the ends thereof disposed in vertically overlapping relationship and hence engaged with a common turret post 34.

Figure 8:
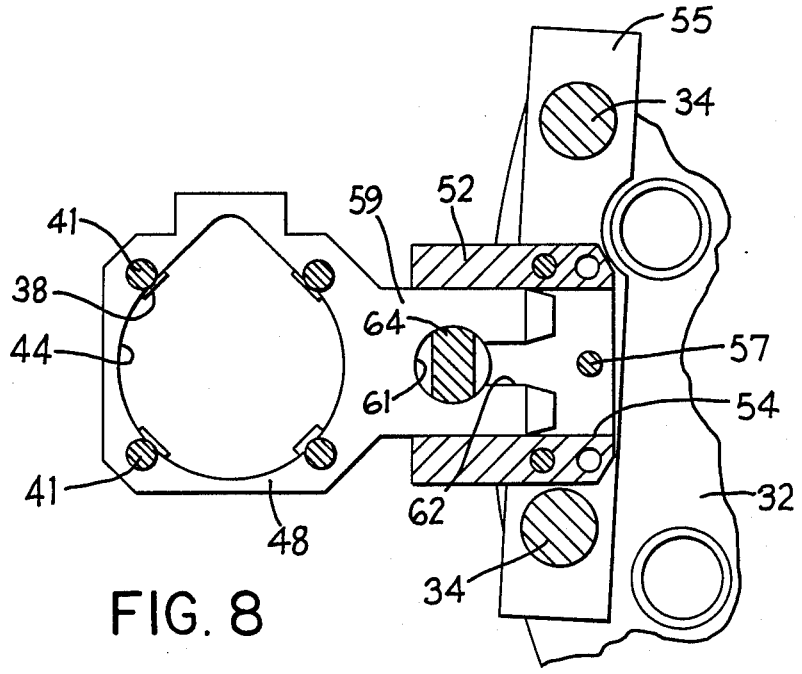
FIG. 8 is an enlarged, fragmentary sectional view taken substantially along line VIII—VIII in FIG. 3.

To permit the stacker unit 23 to be engaged with the locking means 51, each of the mounting plates 48 and 49 as associated with the stacker unit has a sidewardly projecting platelike part 59 (FIGS. 3 and 8) which is adapted to be slidably disposed within the tunnel-like slot 54 of the respective locking plate 52 or 53. The platelike part 59, as illustrated by FIG. 8, has a keyhole-shaped slot 61–62 which opens vertically therethrough and projects inwardly from the free edge thereof. This keyhole slot includes a circular opening 61 which is spaced inwardly from the free edge of the part 59, and this latter opening 61 opens outwardly through the free edge by means of an intermediate slot 62 which is of reduced width. To secure the part 59 within the respective locking plate 52 or 53, the locking means 51 includes a vertically elongated locking rod 63 which is rotatably supported on and extends between the upper and lower locking plates 52 and 53, respectively. This locking rod 63 has vertically spaced locking parts 64 associated therewith, which parts are positioned within the locking plates 52 and 53. This locking part 64, as illustrated by FIG. 8, has a generally rectangular configuration which is created by forming a pair of flats on opposite sides of the locking rod 63 so that the locking part 64 has a width less than the diameter of the rod 63. A handle 65 is secured to and projects radially from the upper end of the locking rod 63. With the locking rod positioned as illustrated in the drawings, the locking part 64 is disposed within the opening 61 and extends transversely relative to the slot 62 so that the stacker unit 23 is hence stationarily and positively mounted on the turret. However, by rotating the locking rod 63 90° from the position illustrated in the drawings, then this results in the locking part 64 being radially aligned with the slot 62, whereupon the complete stacker unit 23 can be easily manually moved radially outwardly so as to disengage it from the turret.

Considering now the foil transfer unit 24, and referring to FIGS. 3–6, same includes a vertically elongated guide pin or rod 71 which projects between and is slidably supported on the turret support plates 31 and 32 in the vicinity of the outer peripheries thereof, there being one such guide pin 71 for each sealing station 21. This guide pin 71 has a holder member 72 fixedly secured thereto at a location between the upper and lower turret support plates. The holder member 72 is also slidably supported on an adjacent turret post 34. This holder member 72 mounts thereon a rotary actuator 73 which is capable of effecting rotary movement through an angle of about 180° relative to a horizontal axis. More specifically, this rotary actuator 73 includes a housing 74 which is fixedly mounted on the holder 72, which actuator housing 74 encloses a rotary actuating element such as a fluid-actuated vane or rotor (not shown), the latter being coupled to drive an actuator shaft 75 (FIG. 7) which projects outwardly from the actuator housing. This actuator shaft 75 is disposed with its axis 76 projecting horizontally in a direction which is generally radially outwardly from the turret axis.

The rotary actuator 73 is a conventional and commercially available unit known as a "FESTO" pneumatic rotary drive so that further description thereof is believed unnecessary.

Figure 7:
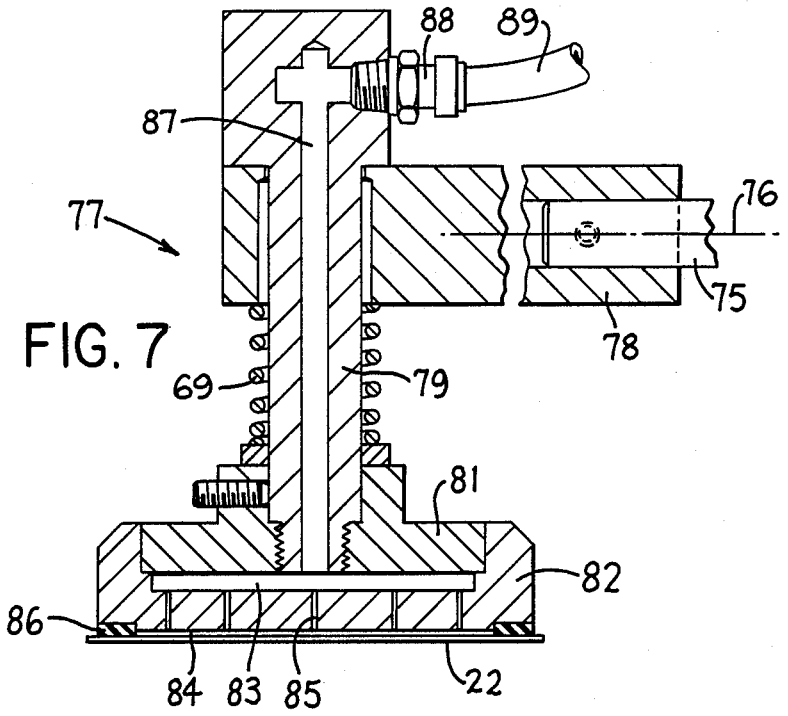
FIG. 7 is an enlarged sectional view of the vacuum head assembly as taken substantially along line VII—VII in FIG. 4.

The foil transfer unit 24 also includes a vacuum head assembly 77 which is mounted on the actuator shaft 75. This vacuum head assembly includes a horizontally elongated arm 78 which is telescopically secured to the actuator shaft 75 so as to rotate therewith about the axis 76. The arm 78 in turn slidably mounts thereon an elongated rod 79 which projects radially relative to the axis 76 and, as illustrated by FIG. 7, has a disk 81 fixedly secured to the radially outer end thereof. A cup-shaped head member 82 in turn is fixedly secured to the disk 81. The head member 82 and disk 81 cooperate to define a small vacuum chamber or space 83 therebetween. This vacuum chamber 83 communicates with the end face 84 of the head member through a plurality of small openings 85 which extend through the head member. The head member also has an elastomeric ring 86 mounted on the end face 84 in surrounding relationship thereto, which elastomeric ring 86 is sized so that it will contact the rim or mouth of the container 13 as explained hereafter. A spring 69 surrounds the rod 79 so as to resiliently maintain the head member in the position shown in FIG. 7.

To apply a vacuum to the chamber 83, the rod 79 has a passage 87 extending therethrough in communication with the chamber 83. This passage 87 at its other end connects to a suitable fitting 88 which in turn connects to a flexible hose 89, the latter at its other end being connected to a control valve 92 (such as a conventional 3-way valve) which, in the illustrated embodiment, is mounted on the lower turret support plate 33. Valve 92 connects to a further hose 91 which connects to a vacuum port formed in the turret hub 31, which vacuum port in turn is connected to a vacuum source (not shown). The valve 92 includes a movable (here pivotally supported) follower 93 which is maintained in engagement with a ring-shaped cam 94. The cam 94 is stationarily secured to a top plate of the housing in concentric relationship relative to the axis 19. The control valve 92 is a conventional "ON-OFF" valve controlled by vertical displacement of its actuating follower 93, whereby there is thus controlled the application of vacuum to the chamber 83 in the head assembly 77.

In similar manner, a supply of pressurized air to the rotary actuator 73 is regulated to control the rotary position of the vacuum head assembly. For this purpose, a pair of air hoses or conduits 95 and 96 are coupled to the rotary actuator 73 and at their opposite ends are connected to a suitable control valve 97 (such as a 4-way valve) which is also mounted on the lower turret support plate 33. An air supply base 105 connects between the valve 97 and an air supply port formed in the turret hub, which port connects to a source (not shown) of pressurized air. Control valve 97 is conventional and includes a vertically movable actuator or follower 98 which is maintained in engagement with a stationary ring cam 99 secured to the housing in concentric relationship to the axis 19. The vertical displacement of follower 98, as caused by the ring cam 99 in response to rotation of the turret, causes the valve 97 to supply pressurized air to one or the other of the hoses 95 and 96, with the other hose then functioning as an exhaust, to effect rotary displacement of the actuator vane and of its shaft 75 in one direction through an angle of 180°. When the follower 98 of valve 97 moves into its other vertical location as controlled by the cam 99, then the functioning of the hoses 95 and 96 is reversed so that pressurized air is then supplied through the other hose, and hence the rotary actuator is reversely rotated through 180° and is maintained in this position until the supply of pressurized air to the actuator is again reversed.

In addition to the oscillating rotary movement imposed on the vacuum head assembly 77 by the rotary actuator 73 as described above, the entire transfer unit 24 is also vertically linearly reciprocated relative to the turret between upper and lower limit positions. This vertical reciprocation of the transfer unit 24 is caused and controlled by a follower (specifically a roller) 101 (FIG. 3) which is mounted on the lower end of the guide rod 71. Roller 101 is maintained in rolling engagement with the upper surface of a ring-shaped cam 102 which is stationarily secured to the housing in concentric relationship to the axis 19. The ring cam 102, like the ring cams 94 and 99, has an axially projecting profile thereon which is maintained in engagement with the roller 101 to effect vertical reciprocating movement of the guide rod 71 and of the entire transfer unit 24. A spring 103 surrounds the guide rod 71 and coacts between the turret and a collar 104 fixed to the guide rod so as to continuously bias the guide rod downwardly to hence maintain the roller 101 in following engagement with the ring cam 102.

It should be noted that a similar biasing structure is also associated with the control valves 92 and 97 since such valves conventionally provide a spring arrangement as an integral part thereof for urging the respective followers downwardly to maintain them in following engagement with their respective ring cams.

Figure 9:
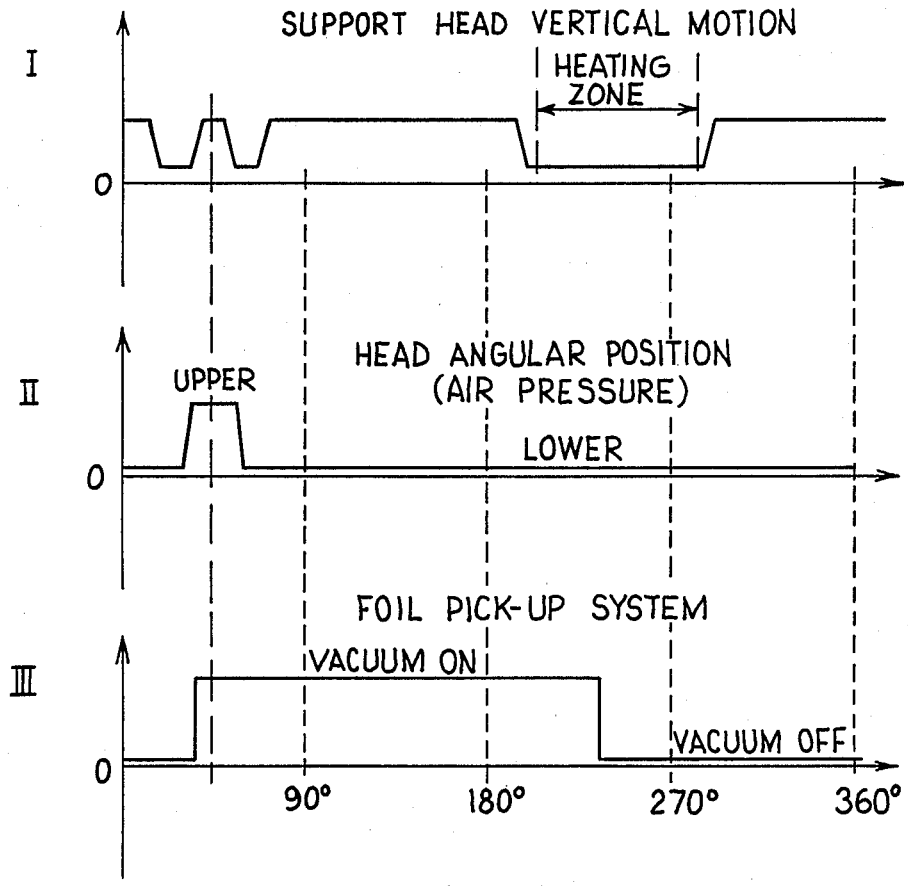
FIG. 9 diagrammatically illustrates the functions of the vacuum support head, and similarly illustrates the profiles of the control cams.

The axial profiles of the ring cams 94, 99 and 102 substantially correspond to the profiles which are diagrammatically illustrated by the respective graphs III, II and I in FIG. 9.

Considering now the supply and discharge devices 12 and 14 respectively, these devices are illustrated only diagrammatically in FIG. 1 inasmuch as such devices are conventional, and numerous other devices could also be provided to accomplish the same function.

As illustrated by FIG. 1, the supply device 12 involves a guideway having sidewardly spaced guides 111 and 112 sidewardly spaced so as to closely confine containers 13 therebetween, which containers may be supported on a conventional moving belt conveyor 113 disposed below the guides. This arrangement feeds empty containers or jars 13 to a rotary star or pocket wheel 114 which rotates about a vertical axis and has pockets 115 in the periphery thereof. These pockets 115 have a configuration conforming to the outer profile of the container 13, and are spaced circumferentially around the wheel 114 at intervals substantially equal to the spacing between the pockets 37 on the main pocket wheel 36. The pocket wheel 114 engages the containers 13 and, in association with the curved inner end of the guide 111, sequentially feeds the empty containers in a synchronous manner into the pockets 37 in a well-understood manner. The pocket wheel 114 is driven from the turret motor through a conventional drive mechanism (not shown) in a continuous rotary movement so that the peripheral speed of the pocket wheel 14 equals the peripheral speed of the pocket wheel 36.

The discharge device 14 has a structure substantially identical to that of the supply device 12 except that it operates in the reverse manner. That is, the discharge device involves a pocket wheel 116 which rotates about a vertical axis and has a peripheral velocity substantially equal to that of the pocket wheel 36 so that the pockets 117 are synchronized with the pockets 37 to sequentially engage the individual containers 13 after foils have been sealed over the mouths thereof, whereupon the pocket wheel 116 in cooperation with the curved guide 118 transports the containers radially outwardly away from the turret arrangement for discharge to a separate location, such as to a capping machine.

As noted above, the guide arrangement 15 extends circumferentially around the turret arrangement in the direction of rotation from the supply device 12 to the discharge device 14, which angular extent is normally at least somewhat in excess of 180°. This guide arrangement 15 includes an elongate arcuate guide plate 121 (FIGS. 1 and 6) which is fixedly mounted relative to the housing and is positioned radially outwardly from the pocket wheel 36 but within substantially the same horizontal plane. This guide plate 121 has an inner guide surface 122 which is generated on a radius about the central axis 19. The spacing between the guide surface 122 and the outer periphery of the pocket wheel 36 is significantly less than the diameter of the containers 13, but this guide surface 122 is spaced from the radially innermost point of the pockets 37 by a distance which only slightly exceeds the outer diameter of the container 13 so that the container 13 is held within the respective pocket 37 and is closely slidably guided along the guide surface 122 during movement of the turret apparatus. This guide plate 121 and the pocket wheel 36 are preferably constructed of a nonmetallic material, such as a resin or other suitable hard plastic or hard rubberlike material so as to prevent marring or damaging the containers. This material should also preferably have a relatively low coefficient of friction to facilitate the movement of the containers. The containers, during their movement along the guide arrangement 15, slide along a smooth top surface 123 defined on the housing.

The guide arrangement 15 also has the heating channel 16 extending therealong over a substantial arcuate extent. This heating channel 16 includes radially inner and outer arcuate support rails 131 and 132 (FIG. 6) which are stationarily supported relative to the housing but are disposed in upwardly spaced relationship relative to the guide plate 121 and pocket wheel 36. These support rails have radii generated substantially about the axis 19. Induction heating elements 133 are secured to and extend longitudinally along the opposed inner surfaces of the support rails 131 and 132, which heating elements 133 are radially spaced apart by a distance which preferably just slightly exceeds the diameter of the container 13. Heating elements 133 are spaced upwardly from the container support surface 123 so as to be disposed closely adjacent the elevation of the container mouth. These support rails 131, 132 and their heating elements 133 hence define a heating channel which extends arcuately around the turret from a location just downstream of the supply device 12, to a location upstream of the discharge device 14. This heating channel preferably extends arcuately around the turret through an angle of at least about 90°, although this obviously varies in dependence on the overall geometrical configuration of the apparatus, the rotational speed of the turret, and the desired heating level.

The opposite ends of the support rails 131 and 132 are joined together by radially extending bridge portions 134 and 135 (FIG. 1), the latter being elevated upwardly so as to pass directly over the mouth of the container. The bridge portion 134 at the upstream end of the heating channel serves to permit the heating elements 133 associated with the inner support rail to be directed radially outwardly so that the heating elements 133 can be connected to a suitable electrical source.

OPERATION

The operation of the sealing apparatus 10 will be briefly described to ensure a complete understanding thereof.

The turret arrangement 11 turns at a uniform rotational velocity in the clockwise direction as indicated in FIG. 1.

Each of the sealing stations 21 has a stacker unit 23 mounted on the turret 17, which stacker unit contains a vertical stack 45 of flexible sealing foils 22 therein.

For purposes of the following description, the discharge point for the containers will be designated as the 0° rotational point, this being indicated as such by the dash-double dot radial line in FIG. 1. When in this 0° position, the transfer unit 24 is disposed vertically in its uppermost position, being held upwardly by the cam 102 against the urging of the spring 103. While the transfer unit is maintained vertically in its uppermost position, nevertheless the vacuum head assembly 77 is, at this time, rotated downwardly into its lowermost position, whereby the transfer unit is hence disposed substantially as illustrated by FIG. 3. At this 0° position, vacuum is not applied to the chamber 83.

Figure 5:
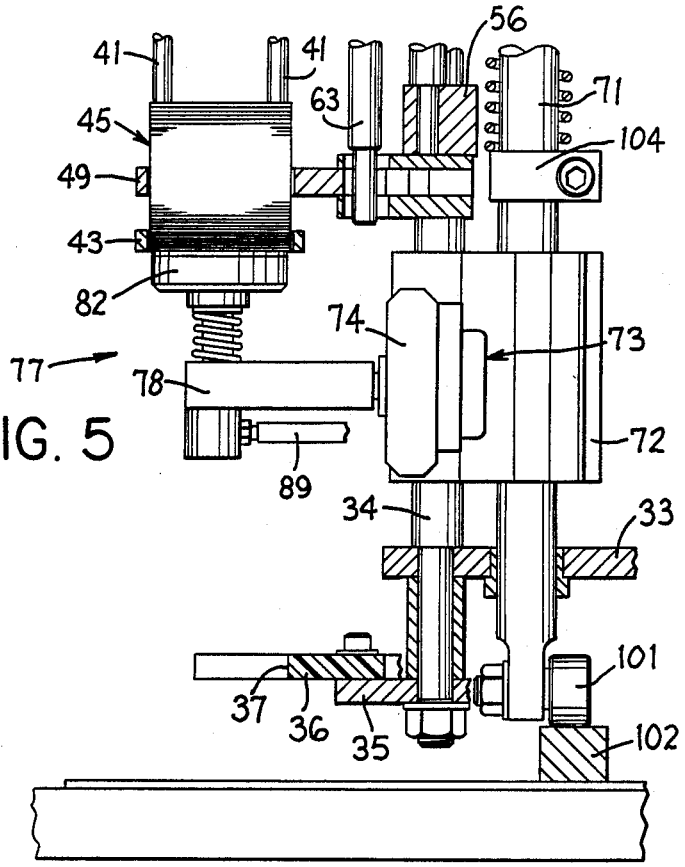
FIG. 5 is a view showing the lower portion of the sealing station as appearing in FIG. 3 but illustrating the vacuum head assembly in a different location.

As the turret arrangement rotatably moves away from the 0° position (that is, away from the container discharge point) toward the container receiving point (that is, toward the supply device 12), the cam ring 102 permits the complete transfer unit 24 to move downwardly to its lowermost position due to the urging of the spring 103 (this lowermost position being indicated substantially by dotted lines in FIG. 3). When reaching this lowermost position, pressurized air is supplied to the rotary actuator 73 which effects rotation of the vacuum head assembly 77 through an angle of 180° about the axis 76 so that the vacuum head member 82 faces upwardly. When in this upper position, however, the end face 84 of the vacuum head 82 is still spaced downwardly a slight distance below the lowermost foil in the respective stack 45. However, substantially when the head member 82 reaches its upwardly facing position, then the cam 102 again drives the transfer unit 24 upwardly into its uppermost position, thus causing the vacuum end face 84 to be moved upwardly into engagement with the lowermost foil in the stack 45. The spring 69 surrounding the head rod 79 enables some slight compression so that the vacuum end face will snugly engage the lowermost foil in the stack and this, coupled with the engagement of the elastomeric ring 86 with the lowermost foil, permits secure engagement with the lowermost foil. When the head member is engaged with the lowermost foil substantially as illustrated by FIG. 5, then the cam 94 actuates the control valve 92 so that vacuum is now created in the chamber 83, which vacuum is sufficient to attach the lowermost foil in the stack to the end face 84 of the head member.

Figure 6:
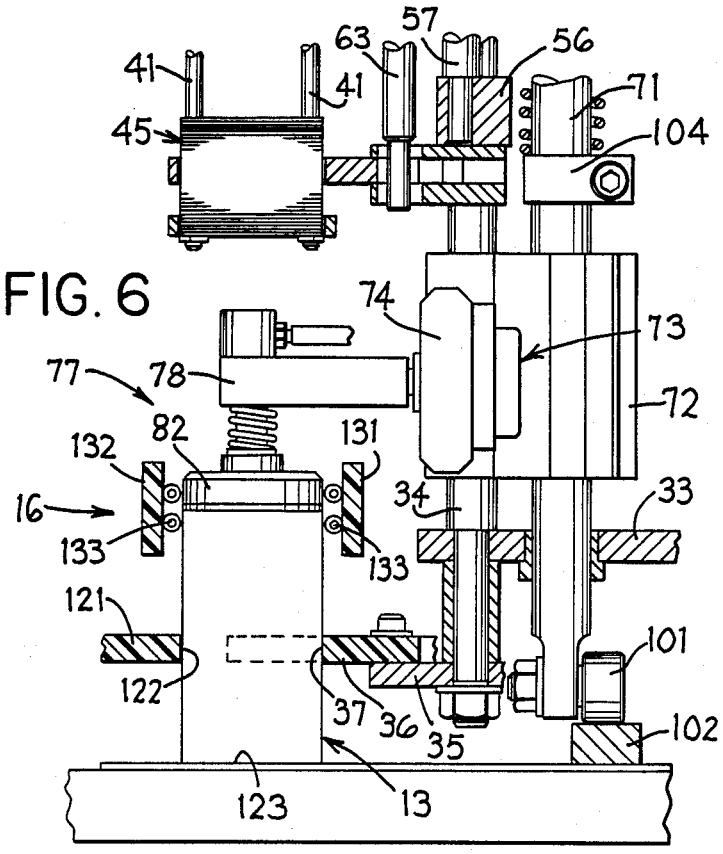
FIG. 6 is a view similar to FIG. 5 but showing the vacuum head assembly in still a further location.

The cam 102 then permits the transfer unit 24 to move downwardly into its lower position so that the lower foil is removed from the stack, and substantially simultaneously therewith the cam 99 switches the control valve 97 to supply pressure to the other side of the rotary actuator 73, whereby the actuator shaft 75 and the vacuum head assembly 77 are then reversely rotated 180° so that the vacuum head 82 and the foil attached thereto now face downwardly so as to be positioned substantially as illustrated by FIG. 6 (although this sealing station 21 has not yet moved into engagement with the container or the heating channel). The vacuum is still maintained in the chamber 83 so as to hold the foil attached to the head member. Shortly thereafter, the ring cam 102 again lifts the transfer unit 24 upwardly into its uppermost position, although the vacuum head member still faces downwardly, thus positioning the vacuum head unit at an elevation so as to permit a container 13 to be moved into position thereunder. All of these prior movements have taken place as the turret rotates continuously away from the 0° position toward but prior to reaching the supply device 12. In fact, all of these prior movements occur during less than about 90° rotation of the turret, as indicated by FIG. 9.

With the transfer unit 24 in the position as last described, and substantially as illustrated by solid lines in FIG. 3, which vacuum head unit has a foil attached thereto, the sealing station 21 then moves to the supply point whereby the supply device 12 moves an empty jar or container 13 into the pocket 37 aligned below the respective vacuum head. Continued rotation of the turret arrangement moves the respective container 13 beneath the bridge portion 134 into the inlet end of the heating channel 16 which immediately initiates heating of the jar mouth. As soon as the sealing station 21 angularly moves past the upstream bridge portion 134, the ring cam 102 again permits the transfer unit 24 to move downwardly into its lower position due to the urging of the spring 103. This causes the vacuum head member 82 and the foil carried thereby to be lowered into engagement with the rim or mouth of the container 13, the foil being clamped between the container rim and the elastomeric ring 86. The spring 69 surrounding the vacuum rod 79 enables vertical floating of the entire vacuum head assembly so that it will properly conform with the rim of the container and yet apply a resilient clamping pressure thereto through the foil. This relationship wherein the foil is clamped to the rim of the jar continues through a substantial arcuate extent, namely through the arcuate extent of the heating channel 16, during which the heating of the container rim and of the foil, coupled with the pressure, enables the foil to be sealingly attached to the container rim. During passage through the heat channel, the cam 94 switches the control valve 92 so that the vacuum in the chamber 83 is discontinued, whereupon the foil is no longer held to the vacuum head.

As the sealing station 21 approaches the downstream bridge portion 135 of the heating channel, the cam 102 again lifts the transfer unit 24 upwardly into its uppermost position, thereby disengaging the vacuum head from the container while leaving the foil sealingly attached to the container mouth. This upward lifting of the transfer unit not only disengages it from the container, but also enables it to be raised so as to vertically clear or pass over the downstream bridge portion 135 during continued rotation of the turret arrangement. The rotation of the turret arrangement continues, and the transfer unit remains in this lattermentioned position until reaching the 0° or discharge point, at which time the container with the sealed foil thereon is discharged by the device 14, and the entire cycle is then repeated.

While the above cycle has been described relative to only a single sealing station 21, it will be apparent that this same cycle will be simultaneously performed with respect to each of the other sealing stations during the continuous rotation of the turret. Hence, foils can be applied and sealed to container mouths at a very rapid rate. At the same time, the apparatus can be operated for long periods of time without shutdown inasmuch as each stacking unit itself contains a large number of foils, and when shutdown is required, the stacking unit can be quickly removed and either refilled and replaced, or in the alternative replaced by a spare unit which has already been prefilled with foils.

It will be appreciated that numerous other valving arrangements can be provided for controlling the vacuum to the vacuum head assemblies, and for controlling the flow of air to the rotary actuators, and that numerous other arrangements can be provided for replacing the hoses or conduits which supply the vacuum or air to the respective devices.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. Apparatus for applying and sealing a thin flexible sheetlike disk to the top rim of an upwardly opening container, comprising:

turret means rotatable about a substantially vertical axis of rotation;

said turret means having a pocket wheel which is concentric therewith and which defines an outer periphery which is substantially concentric with said axis of rotation, said pocket wheel having a plurality of pockets formed therein in substantially uniformly angularly spaced relationship therearound, said pockets having a configuration for at least partially accommodating a container therein;

elongate arcuate guide means positioned radially outwardly of said pocket wheel and extending arcuately along the outer periphery thereof through a substantial extent, said guide means cooperating with said pocket wheel for maintaining containers in said pockets;

heating means positioned adjacent said guide means and extending longitudinally therealong over at least a significant arcuate extent;

a plurality of substantially identical disk applying and sealing mechanisms mounted on said turret means and carried thereby for rotation therewith, said plurality of mechanisms being substantially uniformly angularly spaced around said turret means so that each said mechanism is disposed for cooperation with a single said pocket as provided on said pocket wheel, each said mechanism including a stacker unit mounted on said turret means for containing a vertical stack of said disks therein, and each said mechanism including a disk transfer unit for engaging and removing an endmost disk from a respective said stack and positioning it in engagement with the rim of a container positioned within the respective pocket, each said disk transfer unit including a movable disk-engaging head.

2. An apparatus according to claim 1, including manually releasable locking means cooperating between said turret means and each said stacker unit for permitting each said stacker unit to be individually readily removed from or mounted on said turret means.

3. An apparatus according to claim 1, wherein each said stacker unit is mounted on the turret means so as to be disposed above and substantially vertically aligned relative to a respective said pocket, each said disk transfer unit engaging the lowermost disk in a respective said stack for removing it from the stack and applying it to the rim of a container positioned within the respective pocket, each said disk transfer unit including first means for causing limited vertical reciprocating movement of said disk-engaging head in a substantially vertical direction, and second means for causing rotational displacement of said disk-engaging head through an angle of about 180° relative to a substantially horizontal axis for permitting the disk removed from the stacker unit to be rotatably swung downwardly so as to be positioned over the rim of a container.

4. An apparatus according to claim 3, wherein each said disk-engaging head has vacuum means connected thereto for maintaining a disk in engagement with the disk-engaging head so long as a vacuum is applied thereto, and control means for applying a vacuum to each said disk-engaging head during the time interval during which the disk-engaging head engages and removes the lowermost disk from the respective stacker unit and thereafter applies the removed disk to the rim of a container.

5. An apparatus according to claim 4, including resilient biasing means coacting with each said disk-engaging head and normally urging same in a direction so as to press a disk against the rim of a container when the disk-engaging head is engaged with the rim.

6. An apparatus according to claim 4, wherein said turret means includes generally parallel upper and lower support plates disposed in vertically spaced relationship and fixedly joined together through a support hub which is concentric with and rotatable about said vertical axis of rotation, each disk transfer unit including a vertically extending support post which extends vertically between and is slidably supported on said upper and lower support plates adjacent the peripheral edges thereof, each said disk transfer unit being mounted on a respective said support post, each said first means including spring means normally urging a respective said support post vertically downwardly and cam means coacting with each said support post for controlling upward vertical displacement thereof relative to said turret means.

7. An apparatus according to claim 6, wherein each said disk transfer unit includes a rotary actuator mounted on a respective said support post and having a rotatable actuator shaft which rotates substantially about a substantially horizontal axis, each said disk-engaging head being mounted on a respective said rotatable actuator shaft, each said disk-engaging head having a disk-engaging surface which is disposed within a plane which is substantially parallel to the axis of rotation of a respective said rotatable actuator shaft.

8. An apparatus according to claim 6, including releasable locking means coacting between said turret means and each said stacker unit for permitting a respective said stacker unit to be readily mounted on or detached from the turret means, said releasable locking means including a first pair of vertically spaced locking parts fixedly mounted on said turret means for association with each said stacker unit, and a second pair of vertically spaced locking elements fixedly associated with each said stacker unit and projecting sidewardly therefrom for respective slidable engagement with a respective said pair of locking parts on the turret means, and a vertically elongated manually rotatable locking element extending vertically between each said pair of vertically spaced locking parts for permitting a respective said pair of locking elements to be lockingly engaged therewith.

* * * * *